US011566470B2

(12) United States Patent
Haverinen et al.

(10) Patent No.: US 11,566,470 B2
(45) **Date of Patent: *Jan. 31, 2023**

(54) APPARATUS AND METHOD FOR POSITIONING ROCK DRILLING RIG

(71) Applicant: SANDVIK MINING AND CONSTRUCTION OY, Tampere (FI)

(72) Inventors: Eemeli Haverinen, Tampere (FI); Heikki Tapola, Tampere (FI); Juha Lassila, Tampere (FI); Mervi Avelin, Tampere (FI); Tuomo Hirsikangas, Tampere (FI)

(73) Assignee: Sandvik Mining and Construction Oy, Sandviken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 17/374,109

(22) Filed: Jul. 13, 2021

(65) Prior Publication Data

US 2021/0340825 A1 Nov. 4, 2021

Related U.S. Application Data

(63) Continuation of application No. 16/310,944, filed as application No. PCT/EP2016/065475 on Jul. 1, 2016, now Pat. No. 11,091,962.

(51) Int. Cl.

| | |
|---|---|
| ***E21B 7/02*** | (2006.01) |
| ***E21B 7/04*** | (2006.01) |
| ***E21B 15/04*** | (2006.01) |

(52) U.S. Cl.

CPC ..... *E21B 7/024* (2013.01); *E21B 7/025* (2013.01); *E21B 7/04* (2013.01); *E21B 15/045* (2013.01)

(58) Field of Classification Search

CPC ..... E21B 7/022; E21B 7/024; E21B 7/025

See application file for complete search history.

(56) References Cited

U.S. PATENT DOCUMENTS

2014/0110139 A1* 4/2014 Pursimo ..... E21B 7/025 173/1

* cited by examiner

*Primary Examiner* — Kristyn A Hall

(74) *Attorney, Agent, or Firm* — Corinne R. Gorski

(57) ABSTRACT

An apparatus, a method for positioning a rock drilling, and a rock drilling rig is provided. The rock drilling rig includes a mobile drilling platform and a drilling mast connected to the drilling platform. The drilling platform is levelled vertically before initiating drilling. The apparatus determines the needed vertical levelling requirement. The levelling causes displacement of a drilling tool line passing through a drilling tool. The apparatus estimates the displacement and provides aid for the operator to position the drilling platform in order to compensate for the estimated displacement distance.

15 Claims, 3 Drawing Sheets

APPARATUS AND METHOD FOR POSITIONING ROCK DRILLING RIG

RELATED APPLICATION DATA

This application is a continuation of U.S. patent application Ser. No. 16/310,944 filed Dec. 18, 2018, which is a § 371 National Stage Application of PCT International Application No. PCT/EP2016/065475 filed Jul. 1, 2016.

TECHNICAL FIELD

The present disclosure relates to an apparatus for positioning a rock drilling rig at a drilling site to a drilling position, a rock drilling rig and a method of positioning a rock drilling rig in a drilling position.

BACKGROUND

Substantially vertical drill holes may be drilled by means of surface rock drilling rigs in open pit mines and quarries for producing blast holes. Further, exploration holes may also be drilled by means of surface rock drilling rigs. The drill holes may be drilled by utilizing rotary drilling techniques, for example. The rock drilling rig includes a mobile drilling platform. A drilling mast is connected to the drilling platform by means of a horizontal joint and a drilling machine that is supported movably to the drilling mast. The drilling mast may be tilted as one single entity relative to the horizontal joint. Thus, the drilling mast has only one movable joint allowing adjustment relative to the drilling platform.

At a drilling site the rock drilling rig is positioned to a drilling place. Because the surface of the ground is typically uneven at the drilling site, the drilling platform needs to be levelled before initiating the drilling. The levelling is executed by lifting the drilling platform horizontally by means of several levelling jacks in order to set the drilling platform from an inclined position to a horizontal position. The executed levelling affects are applied not only to the drilling platform but also to the drilling mast, whereby position and orientation of a drilling tool connected to the drilling ma-chine change from the initial position and orientation due to the levelling. The change in position and orientation caused by the levelling needs to be taken into account in the positioning of the rock drilling rig and the drilling tool because otherwise the drilled drill hole is formed incorrectly. It has been found that initial positioning of the drilling rig is a demanding and time consuming task.

SUMMARY

An object of the present disclosure is to provide a novel and improved apparatus, rock drilling rig, and method for positioning a rock drilling rig at a drilling site to a drilling position.

An idea of the disclosed solution is that the apparatus is configured to determine a change in orientation of a drilling tool line caused by a levelling procedure, wherein a drilling platform of a rock drilling rig is lifted vertically after a tramming phase to a levelled position. In the levelled position the drilling platform is set to horizontal position by means of several levelling jacks. The apparatus determines a needed vertical levelling requirement for setting the drilling platform from the initial vertical tramming position to an estimated levelled vertical drilling position. Further, the apparatus estimates displacement of the drilling tool line caused by the estimated levelling. Thus, the apparatus determines a first aiming line passing along the drilling tool at an initial position of the drilling platform and estimates a second aiming line when being lifted to the levelled drilling position. The apparatus determines intersection points between the aiming lines and a reference plane and calculates an estimated displacement between the aiming lines on the reference plane in response to the determined vertical levelling.

Further, the apparatus is configured to indicate the estimated displacement on at least one visual user interface for providing the operator with information for executing the tramming to a proper initial position. Magnitude of the estimated displacement may be considered to represent an advance distance, or stopping distance, compensating for the changed aiming of the drilling tool line. Regarding the terms, the first aiming line may be considered to represent a current or actual drilling line and the second aiming line may be considered to represent an estimated drilling line after the levelling.

An aspect of the disclosed solution is that possible misaiming of the drilling tool and positioning failure caused by the lifting measures of the drilling platform during the levelling procedure may be avoided since the phenomenon of the disclosed estimated displacement is indicated on a visual user interface for the operator. The estimated displacement may thus be easily taken into account already when tramming the rock drilling rig towards the drill hole to be drilled. Thus, the rock drilling rig may be positioned to a correct position in one go without a need for repositioning, which requires time consuming lowering, corrective tramming and relevelling of the drilling platform. When the preparatory work before the actual drilling is quickened, productivity of the actual drilling is improved. Because the displacement is calculated by means of the apparatus and is not based on rough visual and empirical estimation of the operator, more accurate drill holes may be drilled and quality of a blast is improved.

The operator may execute tramming of the drilling platform under guidance provided by one or more visual user interfaces, which facilitate operation by the operator and makes the work of the operator less demanding. Furthermore, the use of the visual user interface, such as a display device, is advantageous since in some constructions of the rock drilling rigs visibility to the drilling place may be limited from a control cabin, whereby position estimation made by the operator is not even possible.

According to an embodiment, the disclosed solution is utilized for drilling angular drill holes. The system is configured to compensate for a parallel displacement that occurs when a tilted drilling tool is, together with the rock drilling rig, lifted upward to the determined levelling position. The aiming line is moved due to the parallel displacement when the rig is raised off the ground.

According to an embodiment, the apparatus is configured to display the estimated displacement in relation to a target drill hole to be drilled next. The apparatus is provided with drill hole data on the target drill hole, and based on that data, the apparatus determines a drill hole line passing along a center line of the target drill hole. Further, the apparatus determines an estimated target position for the first aiming line on the examined reference plane. The estimated target position is located at the determined estimated distance from the drill hole line. When the drilling tool line at the initial tramming position matches with the estimated target position, then the drilling tool line is estimated to match with the drill hole line after the drilling platform has been levelled to the horizontal position and desired vertical height. In other words, the estimated target position indicates for the operator a correct position for tramming the rock drilling rig and thereby quickens and facilitates the tramming phase. In this embodiment the estimated target position is generated in order to compensate for the estimated displacement caused by the estimated vertical levelling. The estimated target position may be displayed together with the drilling tool line and the drill hole line on a display device of a visual user interface by means of graphical symbols.

According to an embodiment, the apparatus is configured to display a position of the drill hole line on a display device by means of a first graphical symbol. Further, the position of the second aiming line is also displayed on the display device by means of a second graphical symbol. Positions of the mentioned first and second graphical symbols are all examined on the reference plane and when the drilling platform is at the initial vertical tramming position.

Further, the apparatus may indicate matching of the first symbol with the second symbol on the display device, whereby the apparatus indicates for the operator when the drilling platform is positioned correctly and may be levelled in order to execute drilling of the target drill hole.

According to an embodiment, the reference plane is a horizontal reference plane and set to a vertical position corresponding with the estimated vertical position of a drill bit of a drilling tool after the levelling is executed. At first, the current position of the drill bit is determined at the initial vertical tramming position on the basis of received sensing data. The drilling mast is instrumented and may include sensors and measuring devices for determining the drill bit position.

The apparatus is configured to project the initial drill bit position vertically to the horizontal reference plane, whereby a predicted drill bit position is formed on the horizontal reference plane. The apparatus further receives drill hole data on a target drill hole to be drilled and determines a drill hole line passing along a center line of the target drill hole and via the start point. Thereafter the start point is transferred along the center line to the horizontal reference plane. The predicted drill bit position and position of the transferred start point are indicated relative to each other on at least one visual user interface. Further, the apparatus determines on the horizontal reference plane an estimated target position for the first aiming line relative to the transferred start point compensating for the estimated horizontal displacement. Relative positions of the predicted drill bit position and the target position are indicated on the at least one visual user interface.

According to an embodiment, and as an alternative to the previous embodiment, the apparatus may examine the horizontal reference plane on any other horizontal plane with which the drilling tool lines have intersection points.

According to an embodiment, the apparatus is configured to monitor allowable lifting distance of the levelling jacks and to compare the monitoring results with the estimated levelling requirement. The apparatus indicates on the visual interface for the operator if too high lifting is required and when no adequate levelling is possible.

According to an embodiment, the apparatus is provided with one or more drilling plans or drilling patterns having drill hole data on several drill holes to be drilled at a drilling site. The drilling plan and the included drill hole data may be displayed on the display device and used for parameters for the calculations and estimations disclosed in this patent application.

According to an embodiment, the apparatus is configured to receive measuring data from at least one inclination measuring device or sensor determining inclination of the drilling platform at the initial tramming position. The drilling platform may be inclined after the tramming phase relative to longitudinal axis of the drilling platform as well as relative to transverse axis. The apparatus determines the magnitude of the vertical levelling requirement on the basis of the received inclination measuring data so that the drilling platform will be horizontally positioned after the levelling. Further, the apparatus may take the inclination data in to account and may minimize magnitude of the vertical levelling height. An advantage of the minimized levelling height is that sufficient drilling depth may be ensured, and further, drilling preparations may be quickened and stability of the drilling platform may be improved at the levelled position when as low levelling height as possible is applied.

According to an embodiment, magnitude of the required vertical levelling height is input or selected by an operator of the rock drilling rig. Thereby, the apparatus may receive magnitude of the required vertical levelling height. The magnitude of the required vertical levelling height may be input or selected, for example, on the basis of visual appearance of the drilling site or practical experience of the operator when the rock drilling rig is positioned. The magnitude of the levelling height may be set to be great enough to ensure proper horizontal positioning of the drilling platform.

According to an embodiment, magnitude of the vertical levelling height is determined on the basis of a surface model of the drilling site. The apparatus is provided with at least one surface model of the drilling site. The surface model has topographical data of the ground. The apparatus determines the magnitude of the needed vertical levelling height at the target drill hole on the basis of the topographical data of the surface model. The surface model may be an electronical three dimensional model (3D), which may be formed by scanning the drilling site in advance.

According to an embodiment, the apparatus is configured to receive surface measuring data from at least one surface measuring device and the apparatus is configured to determine the magnitude of the required vertical levelling height on the basis of the received surface measuring data. The surface measuring means may be onboard the rock drilling machine or external to it.

According to an embodiment, the disclosed solution is utilized for drilling angular drill holes. Drilling angle of the drill hole relative to vertical may be defined as a part of drill hole data received by the apparatus. Alternatively, the drill hole data include position data on a start point and end point of the drill hole and the apparatus calculates drilling angle on the basis of the start and end positions.

According to an embodiment, the apparatus is configured to ensure before executing the levelling that the drilling angle of the drilling tool relative to the drilling platform corresponds with the drilling angle of an angular target drill hole to be drilled next. The drilling angle of the drilling tool is adjustable by tilting a drilling mast relative to a horizontal joint between the drilling mast and the drilling platform. Typically, the tilting of the drilling mast is executed before the levelling phase and no adjustment is executed at the levelled position.

The apparatus receives measuring data from at least one sensing device and determines the tilting angle of the drilling mast relative to the drilling platform, and based on that, determines the drilling angle of the drilling tool. Further, the apparatus compares the drilling angle of the drilling tool to the drilling angle of the target drill hole and prevents initiation of the levelling of the drilling platform until the drilling angle of the drilling tool and the drilling angle of the target drill hole match with each other. This way, it is ensured that the drilling tool has the correct angle for drilling the angular target drill hole, whereby need for readjustment and relevelling may be avoided.

According to an embodiment, the apparatus calculates estimated horizontal displacement for a drilling tool set to a drilling angle relative to the drilling platform by utilizing trigonometric functions. Lifting of the drilling platform causes a parallel displacement for the central axis or aiming line of the drilling tool. Direction of the parallel displacement corresponds with the heading of the drilling tool. A magnitude of the horizontal displacement may, for example, be calculated by means of a trigonometric function utilizing the following formula: HD=LH*tan (DA), wherein HD is the magnitude of the horizontal displacement, LH is the magnitude of levelling height, and DA is the magnitude of the angle of the drilling tool.

According to an embodiment, the disclosed solution is utilized for drilling vertical or substantially vertical drill holes when the vertical drill hole has no drilling angle or magnitude of the drilling angle is insignificant. When the drilling platform is at the initial tramming position inclined relative to the longitudinal axis of the drilling platform, relative to the transverse axis of the drilling platform, or relative to the longitudinal and transverse axes, then execution of the levelling causes the estimated horizontal displacement. The direction of the estimated horizontal displacement is dependent on the detected inclination of the drilling platform relative to one or more axis. The magnitude and the direction of the horizontal displacement may be determined by utilizing trigonometric functions, for example.

According to an embodiment, the apparatus is configured to provide the operator with navigation aid on a display device for facilitating tramming of the rock drilling rig towards an angular target drill hole. The apparatus receives drill hole data on the target drill hole and determines a blasting direction of the target drill hole in response to the received drill hole data. The apparatus receives data on heading of the rock drilling rig and compares the heading to the determined blasting direction.

Further, the apparatus may generate guidance information based on the comparison and may present the guidance information or navigation aid on the visual user interface for aligning the heading of the rock drilling rig and the blasting direction of the target drill hole. The user interface may visualize the heading and the blasting direction relative to each other.

According to an embodiment, the apparatus is configured to receive or determine the heading of the rock drilling rig and blasting direction of an angular target drill hole. The apparatus displays on a display device a horizontal indicator line for indicating the heading of the rock drilling rig in relation to the blasting direction. The apparatus may also be configured to display a horizontal blast line on the display device, compare the indicator line of the heading with the blast line and indicate matching of the indicator line and the blast line to see that the displayed indicator line and the blast line facilitate tramming of the rock drilling rig are in the correct direction.

According to an embodiment, the apparatus is configured to receive data on position and heading of the rock drilling rig and to compare the current position and heading of the rock drilling rig to the start point and blasting direction of the target drill hole. The apparatus is further configured to generate guidance information on the basis of the comparison for executing tramming of the rig to the drilling position, wherein a drilling tool is located at a horizontal displacement distance from the start point and is heading towards the blasting direction. The guidance information may be presented on a visual user interface.

According to an embodiment, the apparatus is configured to receive position and direction data from at least one satellite-based positioning system GNSS (Global Navigation Satellite Systems), such as GPS, GLONASS, Galileo or Compass.

According to an embodiment, the apparatus determines a blasting direction of an angular target drill hole and determines a horizontal blast line corresponding to the determined blasting direction. Further, the apparatus determines position and heading of the rock drilling rig and also determines the position of center of movement of the rock drilling rig. The apparatus may compare the determined position of center of movement to the horizontal blast line and may generate guidance information for moving the center of movement on the blast line. This embodiment is useful especially for rock drilling platforms that are arranged on a track assembly. This kind of track vehicle has a center of movement at a section between the tracks. The track vehicle can be turned around the center of movement without moving the rock drilling rig in any other direction.

Further, the drilling tool may be located on a center line passing through the center of movement. Tramming of the drilling platform may include several consecutive steps. At first the drilling platform is moved under guidance of the disclosed apparatus and visual user interface so that the center of movement is located on the blast line. Secondly, the drilling platform is turned around the center of movement so that the heading of the drilling platform is towards the blasting direction. Thereafter, the drilling platform is moved towards the start point of the target drill hole and is stopped at a distance corresponding to the estimated horizontal displacement from the start point.

According to an embodiment, the apparatus provides the operator with data for aiding selection of one drill hole of a plurality of drill holes defined in a drilling plan or drilling pattern. The aim of this solution is to avoid unnecessary tramming of the rock drilling rig at the drill site. The apparatus is configured to determine position and heading of the rock drilling rig and to compare the current position and heading of the rock drilling to the drilling plan and drill hole data defined in the drilling plan. The apparatus indicates one drill hole of the drilling plan, wherein dedicated drill hole data of the indicated drill hole has a best match with the current position and heading of the rock drilling rig.

According to an embodiment, the apparatus is provided with a drilling plan including a drilling pattern for several drill holes. The drilling plan has pre-defined data on the drill holes to be drilled at the work site. An operator of the rock drilling rig may select one drill hole of the drilling plan to be drilled next. Alternatively, the apparatus may suggest to the operator a drill hole locating appropriately relative to the current position of the rock drilling rig.

According to an embodiment, the disclosed solution may be retrofitted with minimum effort to any existing rock drilling rig intended for drilling vertical or substantially vertical drill holes without utilizing an articulated drilling boom.

According to an embodiment, the apparatus for executing the disclosed positioning aid and visualization is located in a rock drilling rig. The rock drilling rig may have one or more control units provided with needed processing means for implementing the disclosed measures for determining the changes caused by the levelling and for providing navigation aid for tramming the drilling rig to a determined target position or stopping position. The on-board control unit may have one or more display devices and one or more input means allowing interaction between an operator of the rock drilling rig and a computer program being executed in the processing means. By means of the input means measuring data from on-board and external measuring devices may be input to the system, as well as data elements comprising drilling plans, for example.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE FIGURES

For the sake of clarity, the figures show some embodiments of the disclosed solution in a simplified manner. In the figures, like reference numerals identify like elements.

DETAILED DESCRIPTION

Figure 1:
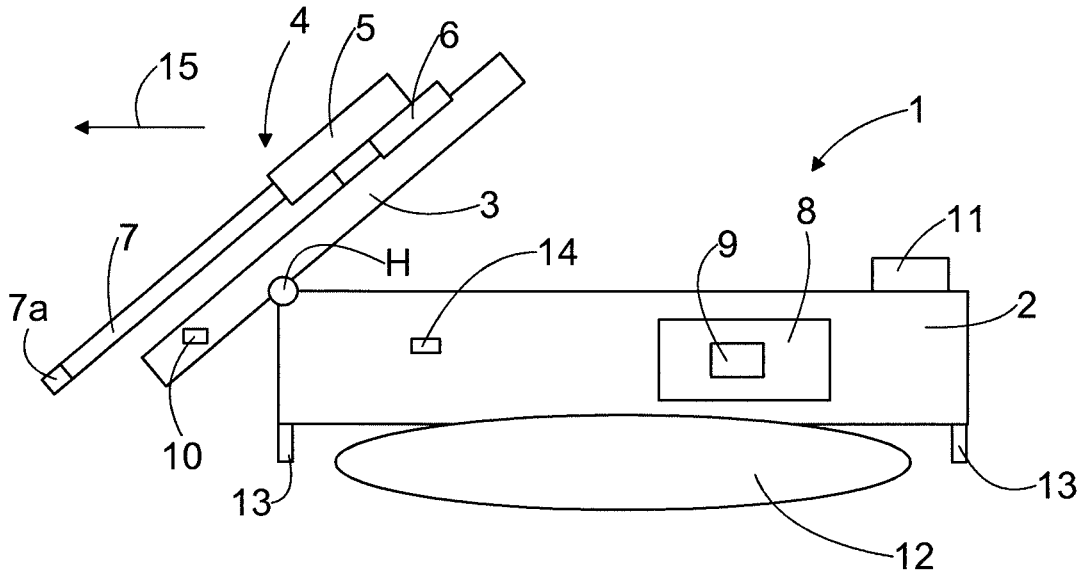
FIG. 1 is a side view of a rock drilling rig according to the present disclosure.

FIG. 1 shows a rock drilling rig 1 including a movable drilling platform 2, a drilling mast 3 and a drilling unit 4 arranged on the drilling mast 3. The drilling unit 4 includes a rock drilling machine 5, which is supported by the drilling mast 3 and can be moved by means of a feed device 6. The drilling mast 3 is connected to the drilling platform 2 by means of a horizontal joint H, whereby the drilling mast may be tilted relative to the drilling platform 2. Further, the drilling unit 4 includes a drilling tool 7, which is rotated by the rock drilling machine 5.

At a distal end of the drilling tool is a drill bit 7*a*. The rock drilling machine 5 may have a rotating device for rotating the drilling tool 7, and at the opposite end portion of the drilling tool 7 may be an impact device, which may be a so called down-the-hole (DTH) impact device.

The rock drilling rig 1 further includes at least one control unit 8 arranged to control actuators of the rock drilling rig 1, for example. The on-board control unit 8 may be a computer, processing device or a corresponding device, and it may have a user interface with a display device 9, as well as control means for giving commands and information to the control unit 8. The control unit 8 may be one computer equipped with appropriate software, or an entity consisting of a plurality of computers.

A drilling pattern for assisting the drilling may be designed in an office or somewhere else external to the rock drilling rig 1 by means of a design computer. The predesigned drilling pattern may be loaded to the control unit 8 of the rock drilling rig 1 and implemented. The set data may be input to the control unit 8 or it may be stored to one or more memory devices so that it can be retrieved by the control unit 8. The operator of the rock drilling rig 1 controls the drilling interactively with the control unit 8.

FIG. 1 further illustrates that measuring or sensing means 10 may be arranged to determine current position and direction of the tool 7. Needed sensor means 14 may locate on the drilling mast 3. Thus, the rock drilling rig 1 and the drilling mast 3 may be instrumented. Alternatively the sensing may be executed remotely.

The rock drilling rig 1 may be provided with a satellite based navigation and positioning system 11. The satellite based navigation and positioning system 11 may be a GPS system having a GPS receiver, a primary antenna and a secondary antenna. The GPS system may also include one or more computational units and/or computers. The devices in the system may be connected by a CAN bus and/or Ethernet connection and/or a serial connection and/or wireless connection or any other suitable connecting means.

Figure 2:
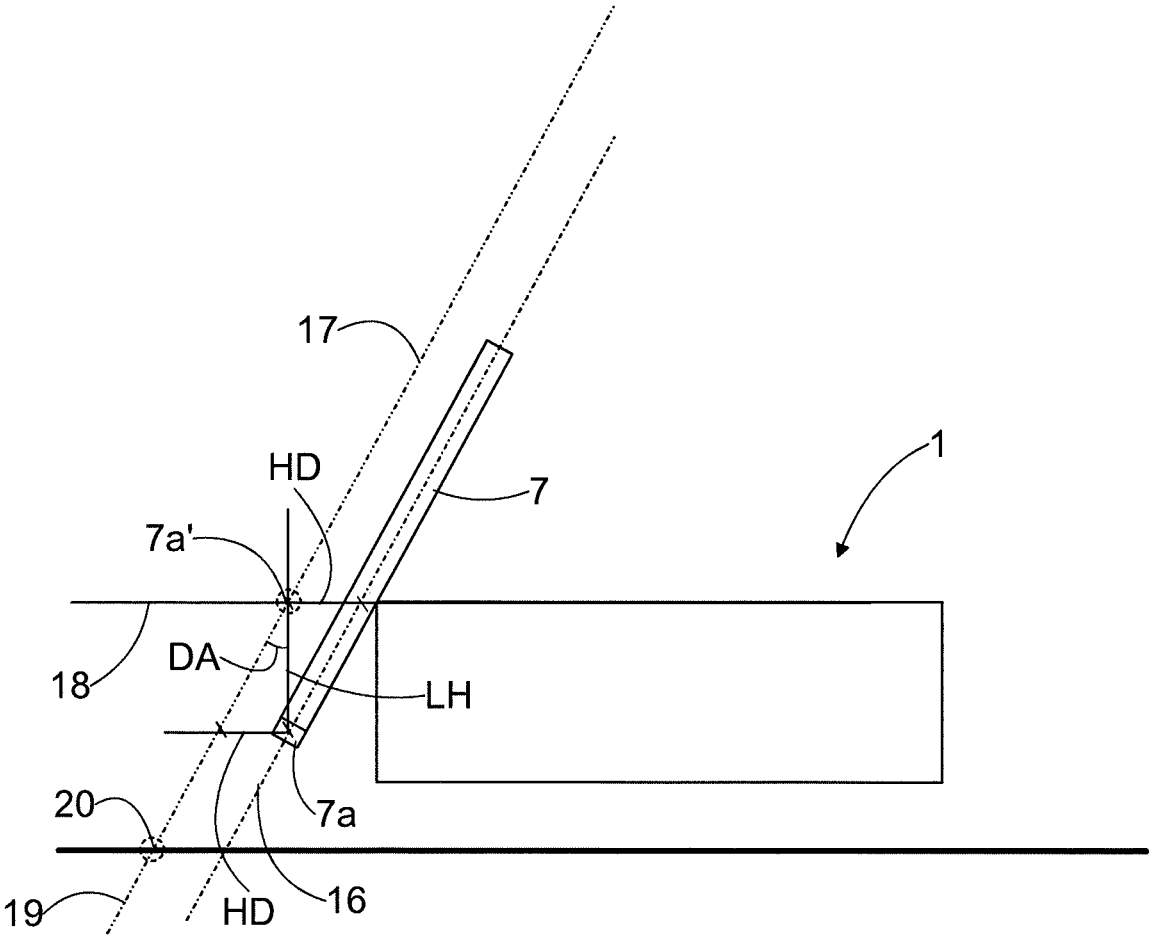
FIG. 2 is a side view of the rock drilling rig before levelling.

FIG. 2 shows the rock drilling rig 1 that is positioned by tramming the drilling platform 2 close to a start point 20 of a target drill hole. Reference numeral 16 denotes the first aiming line. The first aiming line 16 passes along the drilling tool 7. The first aiming line 16 may also be called a current or actual drilling line. Reference numeral 17 denotes the second aiming line. The second aiming line 17 is an estimated drilling line after levelling of the drilling platform 2. The second aiming line 17 passes along the drilling tool 7 at the estimated levelled drilling position.

Reference numeral 18 denotes the reference plane. The first aiming line 16 and the second aiming line 17 have intersection points on the reference plane 18. Due to the levelling there is a displacement between the intersection points of the aiming lines on the reference plane 18.

Reference numeral 19 denotes a drill hole line passing along a center line of the target drill hole. In the presented solution, on the basis of the drill hole line 19 and the displacement between the first and second aiming lines, an estimated target position for the first aiming line 16 is determined on the reference plane 18. The estimated target position is determined for compensating the displacement caused by the levelling. Thus, the second aiming line 17 is estimated to match with the drill hole line 19 at the estimated levelled vertical drilling position.

Figure 3:
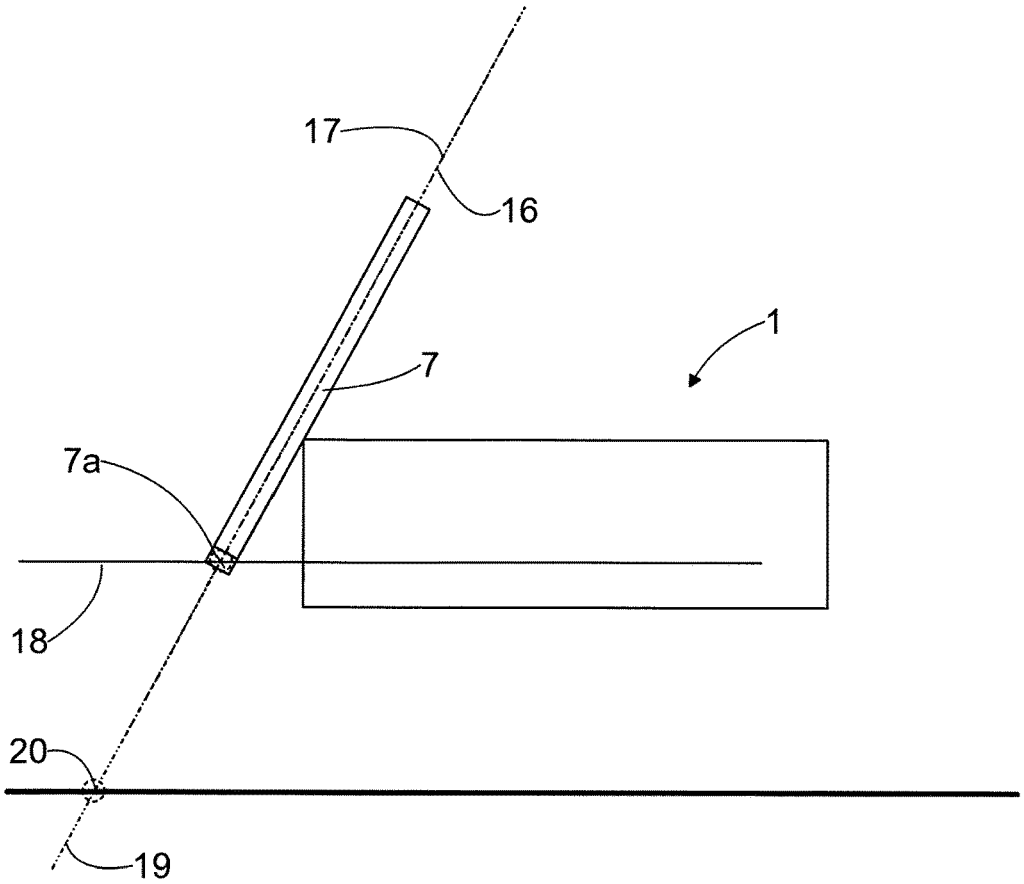
FIG. 3 is a side view of the rock drilling rig after levelling.

As shown in FIG. 3, after levelling, the first aiming line 16 matches with the second aiming line 17. Naturally, after levelling both the first and second aiming lines match with the drill hole line 19 and the rock drilling rig 1 is ready for drilling.

The height of the reference plane 18 may be selected freely. However, the height of reference plane 18 is typically set at the estimated height where the drill bit is located after the levelling.

In FIGS. 2 and 3, the reference plane 18 is a horizontal reference plane. However, it may be possible that the reference plane is not horizontal but the reference plane 18 may be any suitable calculatory reference plane through which the aiming lines 16 and 17 have intersection points.

The estimated displacement between the first and second aiming lines 16 and 17 may be calculated by utilizing trigonometric functions. When the reference plane 18 is a horizontal reference plane the estimated displacement is a horizontal displacement. Lifting of the drilling platform causes a parallel displacement for the central axis or aiming line of the drilling tool. The direction of the parallel displacement corresponds with the heading of the drilling tool. The magnitude of the horizontal displacement may be calculated by means of a trigonometric function utilizing the following formula: HD=LH*tan (DA), wherein HD is magnitude of the horizontal displacement, LH is magnitude of levelling height and DA is magnitude of the angle of the drilling tool.

The solution disclosed in FIGS. 2 and 3 may also be described as follows. First sensing data on position of the drill bit 7*a* of the drilling tool 7 is received. An initial position of the drill bit 7*a* in response to the received sensing data at the initial vertical tramming position is determined. The reference plane 18 is determined as a horizontal reference plane and at the vertical distance from the initial position of the drill bit in response to the determined vertical levelling requirement or levelling height LH. The initial drill bit position is projected vertically to the horizontal reference plane, whereby a predicted drill bit position 7*a*' is formed on the horizontal reference plane 18. Drill hole data on a target drill hole 10 to be drilled is received, wherein the drill hole data includes at least a start point 20. The drill hole line 19 passing along a center line of the target drill hole and via the start point 20 is determined. The start point 20 is transferred along the drill hole line 19 to the horizontal reference plane 18. The predicted drill bit position 7*a*' and position of the transferred start point relative to each other are indicated on at least one visual user interface. An estimated target position for the first aiming line 16 relative to the transferred start point on the horizontal reference plane is determined for compensating the estimated horizontal displacement HD. The relative positions of the predicted drill bit position 7*a*' and the estimated target position are indicated on the at least one visual user interface.

Figure 4:
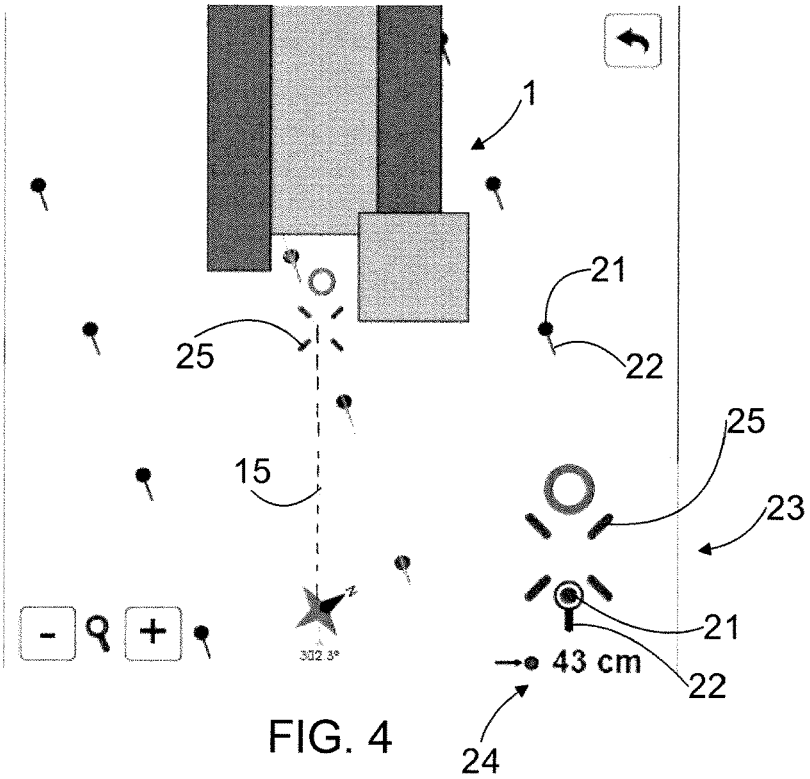
FIG. 4 schematically shows a user interface of the rock drilling rig.

FIG. 4 illustrates a user interface showing a birds eye view pane of hole alignment information. The lower right corner of FIG. 4 shows a zoomed hole alignment widget 23. The user interface may also have a drilling plan/hole pane and/or a hole information pane, for example.

The user interface shows drill hole indicators 21. In angular drilling, the drill hole indicator 21 also includes a blasting direction indicator 22. The user interface also shows the heading 15 of the rock drilling rig 1. The user interface is configured to provide the operator with navigation aid for facilitating tramming of the rock drilling rig 1 towards the target drill hole. On the basis of the drill hole data on the target drill hole the blasting direction of the target drill hole is determined. On the basis of data on heading of the rock drilling rig the heading of the rock drilling rig is determined and the heading is compared to the blasting direction. The user interface shows the heading 15 and the blasting direction indicator 22 and thus presents guidance information of navigation aid for aligning the heading of the rock drilling rig and the blasting direction of the target drill hole.

Figure 5A:
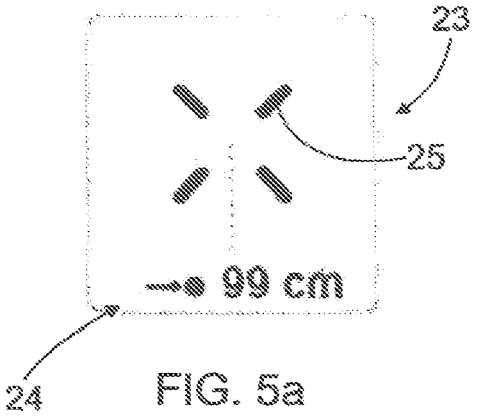
FIGS. 5*a*, 5*b*, 5*c* and 5*d* schematically show a zoomed view of the user interface shown in FIG. 4.

The zoomed hole alignment widget 23 has a selected hole distance indicator 24. When the rock drilling rig 1 approaches the selected hole the selected hole distance indicator 24 changes or updates accordingly. In the situation disclosed in FIG. 5*a* the distance of the rock drilling rig 1 to the selected hole is too big and therefore the zoomed hole alignment widget 23 does not show the drill hole indicator 21 at all. Thus, only the open centered "x" marker representing a second aiming line indicator 25 is shown in the zoomed hole alignment widget 23.

Figure 5B:
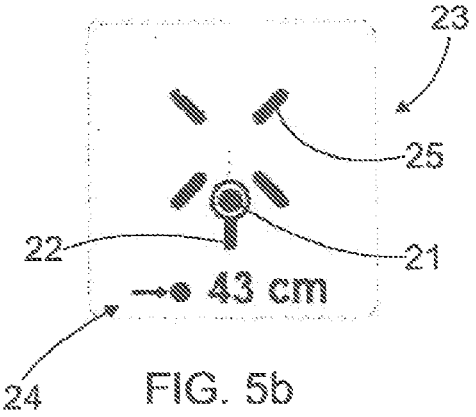

When the rock drilling rig 1 comes closer to the selected hole, the zoomed hole alignment widget 23 shows the drill hole indicator 21 of the selected drill hole. This is illustrated in FIG. 5*b*. The zoomed hole alignment widget 23 also shows the selected hole distance indicator 24. In the zoomed hole alignment widget 23 the drill hole indicator 21 represents the position of the drill hole line 19 on the reference plane. The second aiming line indicator 25 represents the position of the second aiming line 17 on the reference plane.

Figure 5C:
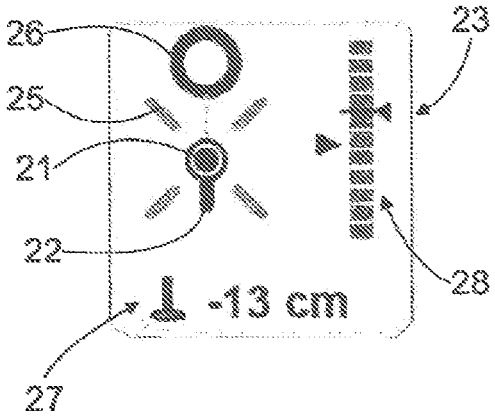

In FIG. 5*c* the second aiming line 17 matches with the drill hole line 19. Thus, FIG. 5*c* shows the situation as illustrated in FIG. 2. In the zoomed hole alignment widget 23 the second aiming line indicator 25 matches with the drill hole indicator 21. In this situation the color of the second aiming line indicator 25 may change.

In FIG. 5*c* the zoomed hole alignment widget 23 shows a first aiming line indicator 26. The first aiming line indicator 26 indicates the position of the first aiming line 16 on the reference plane.

In the FIGS. 2 and 5*c* the drilling platform 2 is ready for levelling. In the zoomed hole alignment widget the selected hole distance indicator 24 has disappeared but instead a levelling requirement indicator 27 is shown. Also a levelling indicator 28 illustrating the levelling situation is shown.

Figure 5D:
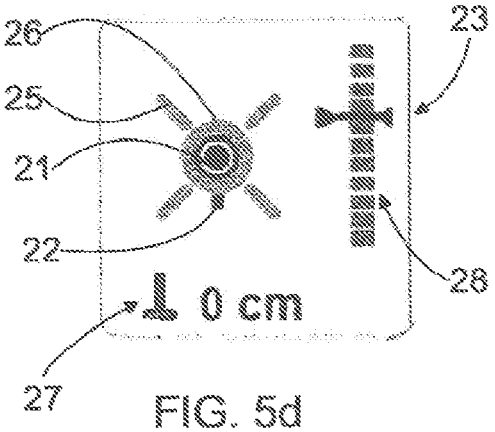

FIG. 5*d* shows the situation after levelling. The situation in FIG. 5*d* corresponds to the situation illustrated in FIG. 3. Thus, the first aiming line 16 matches with the drill hole line 19 and the zoomed hole alignment widget 23 indicates the matching of a first aiming line indicator 26 with the drill hole indicator 21 and the second aiming line indicator 25.

The disclosed apparatus includes at least a processing device for determining current position and direction of a tool and assisting or executing the disclosed creation and modifying procedures. Data may be input to the processing device as individual data elements or may be retrieved from one or more memory devices. The processing device may have a computer program product, which is executed. The computer program may be recorded on non-transitory computer-readable media including program instructions for implementing various operations executed by a computer. The operator may input data and make selections via one or more input devices. The input device may be a touch screen, a keypad, a mouse or any other suitable control device. The processing device may execute needed calculations and may display drilling and positioning data on a display device. The processing device may also provide the operator with predetermined drilling aid and may show assisting symbols and data on the display 10 device. Further, the apparatus may include an output device for storing produced data on a memory device or transmitting the data to another control unit or mining vehicle. It should be appreciated that the processing device and a control unit of the rock drilling rig may be separate devices or they can be integrated.

A computer program for implementing the features disclosed herein may be recorded in non-transitory computer-readable media including program instructions to implement various operations embodied by a computer. The media may also include, alone or in combination with the program instructions, data files, data structures, and the like. Examples of computer-readable media or computer-readable storage devices include magnetic media such as hard disks, and optical media such as CR-ROM disks and DVDs, flash memory means, and hardware devices that are configured to store software. The computer-readable media may be a plurality of computer-readable storage devices in a distributed network, so that the program instructions are stored in a plurality of computer-readable storage devices and executed in a distributed fashion. The program instructions may be executed by one or more processors or processing devices.

Although the present embodiments have been described in relation to particular aspects thereof, many other variations and modifications and other uses will become apparent to those skilled in the art. It is preferred therefore, that the present embodiments be limited not by the specific disclosure herein, but only by the appended claims.

What is claimed is:

1. An apparatus comprising at least one data processing device arranged for determining a drilling position for a rock drilling rig for drilling at least one drill hole at a drilling site, and wherein the rock drilling rig includes a mobile drilling platform and a drilling mast provided with a rock drilling machine and a drilling tool connected to the rock drilling machine, the drilling mast being tilted relative to the drilling platform to set an angle of the drilling tool to correspond with a drilling angle of a target drill; wherein the rock drilling rig is positioned by tramming the drilling platform to a drilling position in accordance with a start point of the target drill hole, the drilling mast, the drilling unit and the drilling tool are arranged to move vertically, the apparatus being configured to perform the steps of:

receiving sensing data on position and orientation of the drilling tool;

determining a first aiming line passing along the drilling tool at an initial vertical tramming position of the drilling platform;

determining data on a vertical levelling requirement for levelling the drilling platform from the initial vertical tramming position to an estimated levelled vertical drilling position;

determining a second aiming line passing along the drilling tool at the estimated levelled drilling position; determine intersection points between the aiming lines and a reference plane;

calculating an estimated displacement between the aiming lines on the reference plane in response to the determined vertical levelling requirement;

indicating the estimated displacement on at least one visual user interface; and levelling the drilling platform by tramming the drilling platform vertically from the initial vertical tramming position to the levelled vertical drilling position.

2. The apparatus as claimed in claim 1, wherein the apparatus is further configured to:

receive drill hole data on a target drill hole to be drilled;

determine a drill hole line passing along a center line of the target drill hole; and determine on the reference plane an estimated target position for the first aiming line at a distance corresponding with the estimated displacement and relative to the drill hole line compensating for the estimated displacement caused by the levelling, whereby the second aiming line is estimated to match with the drill hole line at the estimated levelled vertical drilling position.

3. The apparatus as claimed in claim 2, wherein the apparatus is further configured to:

display a position of the drill hole line on a display device by means of a first graphical symbol;

display a position of the second aiming line by means of a second graphical symbol on the display device;

display positions of the drill hole and second aiming lines on the reference plane; and indicate matching of the first graphical symbol with the second graphical symbol on the display device.

4. The apparatus as claimed in claim 3, wherein the apparatus is further configured to:

display a position of the first aiming line by means of a third graphical symbol; and indicate matching of the third graphical symbol with the first and second graphical symbols.

5. The apparatus as claimed in claim 1, wherein the apparatus is further configured to:

determine data on inclination of the drilling platform at the initial vertical tramming position;

estimate direction of the displacement in response to the received data on the inclination; and determine an estimated target position on the reference plane at the estimated distance and direction corresponding with the estimated displacement.

6. The apparatus as claimed in claim 1, wherein the apparatus is further configured to:

receive sensing data on position of a drill bit of the drilling tool;

determine the initial position of the drill bit in response to the received sensing data at the initial vertical tramming position;

determine the reference plane as a horizontal reference plane and at a vertical distance from the initial position of the drill bit in response to the determined vertical levelling requirement;

project the initial drill bit position vertically to the horizontal reference plane, whereby a predicted drill bit position is formed on the horizontal reference plane;

receive drill hole data on a target drill hole to be drilled, wherein the drill hole data comprises at least a start point;

determine a drill hole line passing along a center line of the target drill hole and via the start point;

transfer the start point along the center line to the horizontal reference plane; indicate the predicted drill bit position and position of the transferred start point relative to each other on at least one visual user interface;

determine on the horizontal reference plane an estimated target position for the first aiming line relative to the transferred start point compensating for the estimated horizontal displacement; and indicate relative positions of the predicted drill bit position and the estimated target position on the at least one visual user interface.

7. The apparatus as claimed in claim 1, wherein the apparatus is further configured to:

receive sensing data on the position and orientation of the drilling tool;

determine heading of the drilling tool in response to the received sensing data; receive drill hole data on a target drill hole to be drilled;

determine a drill hole line passing along a center line of the target drill hole; compare heading of the drilling tool with the drill hole line; and indicate a target position on the reference plane at the estimated horizontal displacement distance and in the direction towards the drill hole line when the drill hole line is located in the direction of the heading of the drilling tool.

8. The apparatus as claimed in claim 1, wherein the apparatus is further configured to receive measuring data from at least one inclination measuring device determining inclination of the drilling platform at the initial tramming position and determine the magnitude of the vertical levelling requirement on the basis of the received inclination measuring data.

9. The apparatus as claimed in claim 1, wherein the apparatus is further configured to:

receive drill hole data on a target drill hole to be drilled;

determine a blasting direction of the target drill hole in response to the received drill hole data; and determine the estimated displacement in the direction corresponding with the determined blasting direction.

10. The apparatus as claimed in claim 1, wherein the apparatus is further configured to:

receive drill hole data on an angular target drill hole;

determine a drilling angle of the target drill hole;

receive measuring data from at least one sensing device and determine a tilting angle of the drilling mast relative to the drilling platform;

determine drilling angle of the drilling tool relative to the drilling platform and in response to the determined tilting angle;

compare the drilling angle of the drilling tool to the drilling angle of the target drill hole; and prevent initiation of the levelling of the drilling platform until the drilling angle of the drilling tool and the drilling angle of the target drill hole match with each other.

11. The apparatus as claimed in claim 1, wherein the apparatus is further configured to:

receive drill hole data on a target drill hole to be drilled;

determine blasting direction of the target drill hole in response to the received drill hole data;

receive data on heading of the rock drilling rig;

compare the heading to the determined blasting direction; and provide information on the visual user interface of alignment of the heading and the blasting direction.

12. The apparatus as claimed in claim 1, wherein the apparatus is further configured to:

determine a blasting direction of an angular target drill hole;

determine a horizontal blast line corresponding the blasting direction;

receive data on position and heading of the rock drilling rig; determine position of center of movement of the rock drilling rig; and compare the determined position of center of movement to the horizontal blast line and generate guidance information for moving the center of movement on the blast line.

13. The apparatus as claimed in claim 1, wherein the apparatus is further configured to:

receive position data of the rock drilling rig;

determine current position and heading of the rock drilling rig;

receive a drilling plan comprising several drill holes and being provided with drill hole data comprising at least position data on start points and end points;

determine blasting directions of the drill holes;

compare the current position and heading of the rock drilling to the drilling plan and the defined drill hole data; and indicate one drill hole of the drilling plan the dedicated drill hole data of which drill hole best matches with the current position and heading of the rock drilling rig.

14. A rock drilling rig comprising:

a mobile drilling platform;

a drilling mast connected to the drilling platform by horizontal tilting joint;

a drilling unit supported movably to the drilling mast and including a rock drilling machine; and several levelling actuators for lifting the drilling platform vertically from an initial vertical tramming position to a levelled vertical drilling position; wherein the rock drilling rig includes an apparatus according to claim 1.

15. A method of drilling angular drill holes, the method comprising:

providing a drilling a rock drilling rig including a mobile drilling platform, a drilling mast, at least one rock drilling unit supported by the drilling mast and a drilling tool connected to the drilling unit, the drilling mast, the drilling unit and the drilling tool being arranged to move vertically;

determining a target drill hole to be drilled;

tilting the drilling mast relative to the drilling platform to set an angle of the drilling tool to correspond with a drilling angle of the target drill hole and in response to the drilling platform;

positioning the rock drilling rig by tramming the drilling platform to a drilling position in accordance with a start point of the target drill hole;

leveling the drilling platform after the tramming vertically from the initial vertical tramming position to a levelled vertical drilling position, whereby also;

drilling a drill hole by means of the drilling tool;

receiving sensing data on position and orientation of the drilling tool;

determining a first aiming line passing along the drilling tool at an initial vertical tramming position of the drilling platform;

determining data on vertical levelling requirement for levelling the drilling platform from the initial vertical tramming position to an estimated levelled vertical drilling position;

determining a second aiming line passing along the drilling tool at the estimated levelled drilling position;

determining intersection points between the aiming lines and a reference plane;

calculating an estimated displacement between the aiming lines on the reference plane in response to the determined vertical levelling requirement;

indicating the estimated displacement for providing positioning information; and moving by means of the tramming the drilling tool at the displacement distance from the target drill hole until initiating the leveling.

* * * * *